United States Patent [19]

Zehavi et al.

[11] Patent Number: 4,825,492

[45] Date of Patent: May 2, 1989

[54] RAPID DEPLOYMENT STATIONARY BRIDGE

[75] Inventors: Eitan Zehavi, Kiriat Tivon; Yair Tene, Haifa, both of Israel

[73] Assignee: The State of Israel, Ministry of Defence, Israel Military Industry, Israel

[21] Appl. No.: 76,021

[22] Filed: Jul. 21, 1987

[30] Foreign Application Priority Data

Aug. 28, 1986 [IL] Israel ..... 79874

[51] Int. Cl.[4] ..... E01D 15/12

[52] U.S. Cl. ..... 14/1; 14/2.4

[58] Field of Search ..... 14/1, 3–7, 14/2.4, 17, 13

[56] References Cited

U.S. PATENT DOCUMENTS

| | | | |
|---|---|---|---|
| 4,288,881 | 9/1981 | Mahncke et al. | 14/2.4 |
| 4,520,523 | 6/1985 | Fitzgerald-Smith et al. | 14/2.4 |
| 4,635,311 | 1/1987 | Helmke | 14/2.4 |
| 4,665,577 | 5/1987 | Parramore | 14/2.4 |
| 4,706,436 | 11/1987 | Mabey et al. | 14/4 X |

*Primary Examiner*—Jerome W. Massie
*Assistant Examiner*—Matthew Smith
*Attorney, Agent, or Firm*—Steinberg & Raskin

[57] ABSTRACT

A rapid deployment stationary bridge. The bridge comprises a central girder flanked by two side girders, each of the central and side girders consisting of a plurality of aligned and connected sections.

For deployment the central girder is first assembled on one bank of an obstacle by aligning and interconnecting the constituent sections thereof. As the assembly progresses the central girder is launched by gradual advancing it towards the opposite bank. Some time after the commencement of the assembly and launching of the central girder the side girders are assembled by slidably mounting the constituent sections of each side girder in alignment on one side of the central girder and interconnecting them. In the course of their being assembled, the side girders are launched in such a way that the advancement of the side girders lags behind the advancement of the central girder.

17 Claims, 10 Drawing Sheets

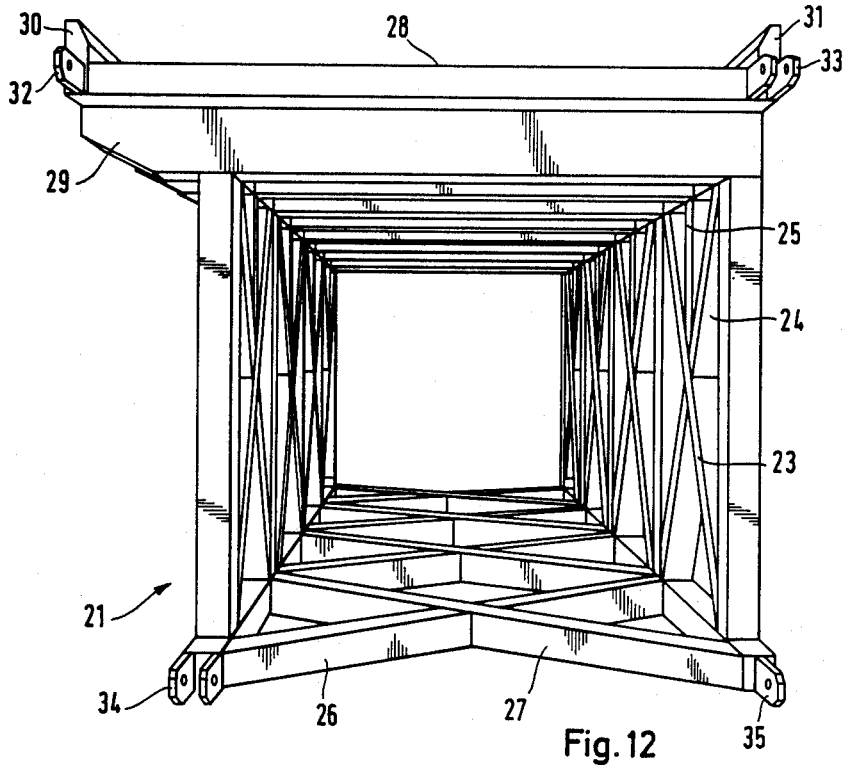
Fig. 12
Fig. 11
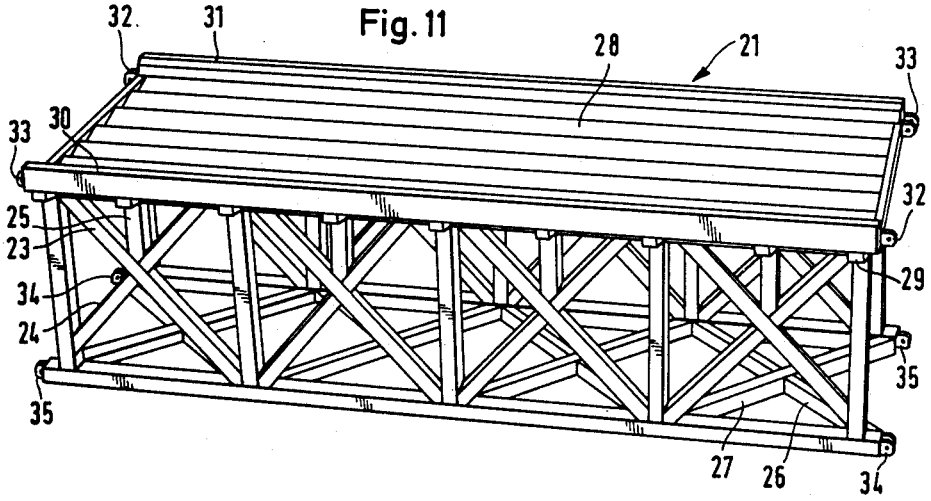

RAPID DEPLOYMENT STATIONARY BRIDGE

BACKGROUND OF THE INVENTION

The present invention concerns a rapid deployment stationary bridge, section units for the assembly of such a bridge and a method for the assembly and launching thereof.

Rapid deployment stationary bridges are required for both civil and military applications whenever it is necessary to rapidly bridge obstacles such as a river, a canyon and the like, and also for replacement of bridges destroyed in consequence of a natural disaster or an act of war.

Rapid deployment stationary bridges have to combine a satisfactory load carrying capacity with a reasonable span of say up to about 60 meters and a simple design to enable assembly and launching in minimum time. It is further desirable that the bridge design be versatile to adapt it for bridging obstacles of varying widths.

Existing bridging equipment does not meet all these requirements. Thus, for example, the so-called Bailey bridges require relatively long construction and dismantling times which puts serious restrictions on their use for military purposes. Bridges that are launched by so-called bridging tanks are designed for rapid deployment but their length is limited and they do, as a rule, not exceed about 23 meters even where they are of the telescoping type.

It is accordingly the object of the present invention to provide a rapid deployment bridge combining satisfactory load carrying capacity with a satisfactory maximum length and being versatile whereby its length is adaptable to the width of the obstacle to be spanned by the bridge.

SUMMARY OF THE INVENTION

In accordance with the present invention there is provided a rapid deployment stationary bridge comprising a central girder flanked by and joined to two side girders, each of said central and side girders consisting of a plurality of aligned and connected sections and each having end sections adapted for resting on a bank of an obstacle to be bridged, each of the sections of said side girders having an upper panel whereby a trackway is formed on each of said side girders.

The joining of the side girders to the central girder may be by way of a loose engagement or by a secure connection such as by means of transversal screws or bolts.

Each of the three girders forming a bridge according to the invention comprises different constituent sections such as high and low sections with substantially parallel upper and lower edges, transition sections in which the lower and upper edges converge in the direction of the closest end, and end sections with flat terminal parts, adapted each to rest on a bank of the obstacle.

In the following, a portion of a girder that comprises an end, low and transition section will be referred to at times as "end portion".

The trackways on the two side girders of a bridge according to the invention support the wheels or chains of a passing vehicle and the stresses resulting from the load on the bridge are distributed between the two side girders and the central girders. The central girder accordingly serves, among others, as a reinforcement for the two side girders, in addition to its role in the assembly and launching of the bridge as will be explained below.

The invention further provides a set of sections for the assembly of a stationary bridge of the kind specified, comprising two end sections, two transition sections and a plurality of low and high sections for the center girder and four end sections, four transition sections and a plurality of low and high sections for the side girders, which side girder sections all have an upper, trackway forming panel.

The constituent sections according to the invention may be of any suitable material such as steel, aluminum, aluminum alloys, various tough synthetic materials and the like.

Still further, the invention provides a method of deployment of a stationary bridge of the kind specified across an obstacle, comprising:

(i) assembling a central girder on one bank of the obstacle (assembly bank) by aligning and interconnecting the constituent sections thereof and as the assembly progresses, launching the central girder by gradually advancing it towards the opposite bank of the obstacle;

(ii) assembling two side girders on the same bank by slidably mounting the constituent sections of each side girder in alignment on one side of the central girder and interconnecting said sections;

(iii) launching said side girders by gradually sliding them towards the opposite bank along the central girder so that the advancement of the side girders lags behind the advancement of the central girder;

(iv) continuing said assembly and launching operations until the end sections of the central and side girders rest abreast on the opposite bank of the obstacle.

Where in the assembled bridge the two side girders do not abut each other it is possible, if desired, to insert panels to close the gap between the side girders.

In performing the above method it is possible, if desired, to use at the assembly bank support elements such as rollers, to facilitate the advancement of the girders from the assembly bank to the opposite bank.

Due to the fact that the launching of the side girders lags behind the launching of the central girder, the former bear on the latter at the launching bank with the consequence that the central girder overhangs the obstacle in a cantilever beam like fashion until it reaches the opposite bank.

Depending on the width of the obstacle to be bridged, the girders in a bridge according to the invention may in case of a very narrow obstacle consist each simply of two end sections, or, in case of somewhat wider obstacles, of two end sections and one or more low sections. Normally, where the bridge has to span a wide obstacle it will comprise all four kinds of sections to wit, two end sections, one at each end, at least one low section, two transition sections and at least one high section, each girder thus comprising two end sections.

BRIEF DESCRIPTION OF THE DRAWINGS

The invention will now be described by way of example with reference to the annexed drawings in which:

FIG. 11 is a side perspective view of a high section according to FIG. 10 drawn to a larger scale;

FIG. 12 is an end perspective view of a high section according to FIG. 10 drawn to a larger scale;

DESCRIPTION OF THE PREFERRED EMBODIMENT

Figure 1:
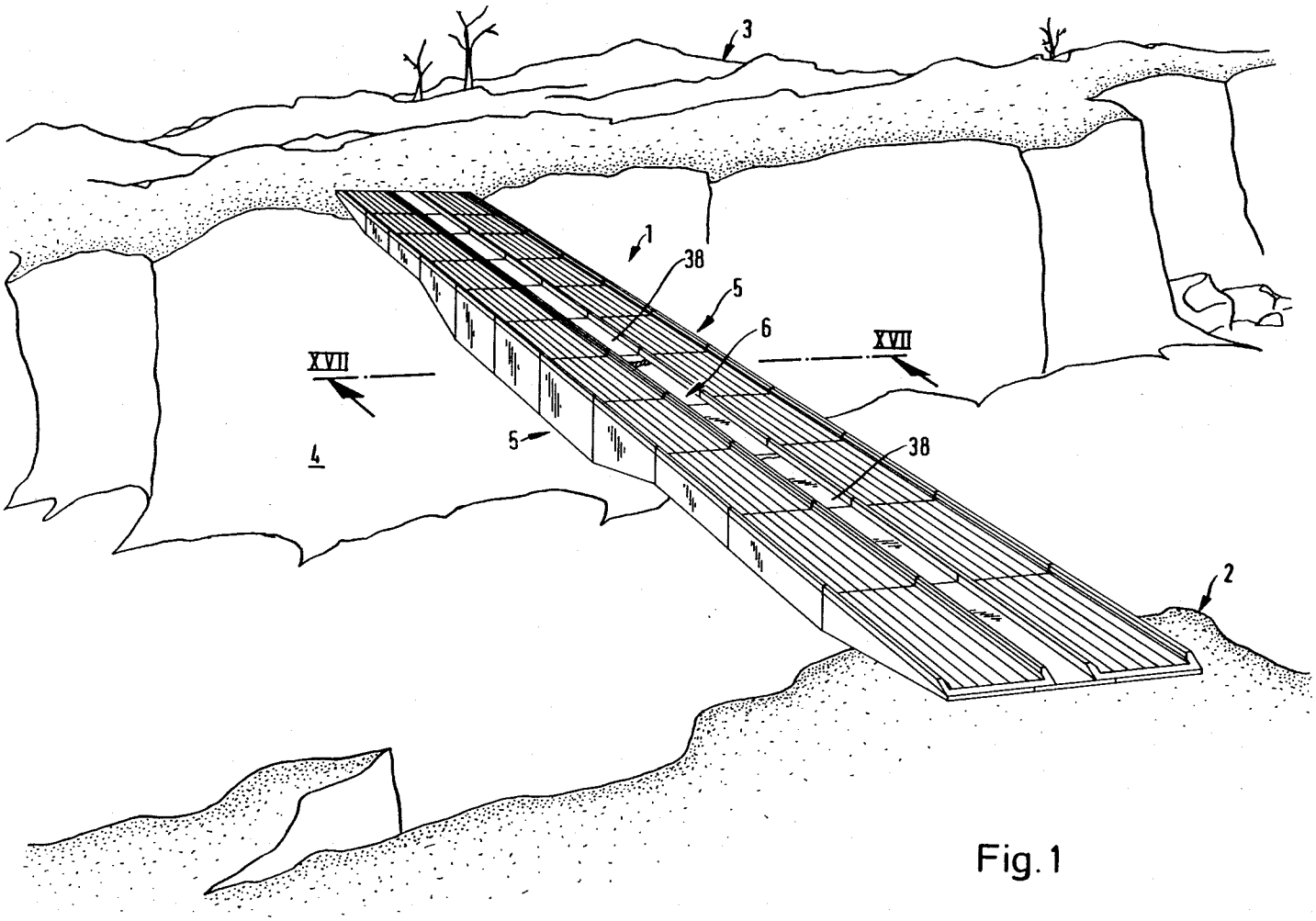
FIG. 1 is a pictorial view of an assembled bridge according to the invention.

The bridge 1 according to the invention shown in FIG. 1 links the two banks 2 and 3 of a canyon 4, bank 2 being the assembly bank. The bridge comprises two side girders 5 and a central girder 6. Each of girders 5 and 6 is made of aligned connected sections which will be described more closely below.

Figure 2:
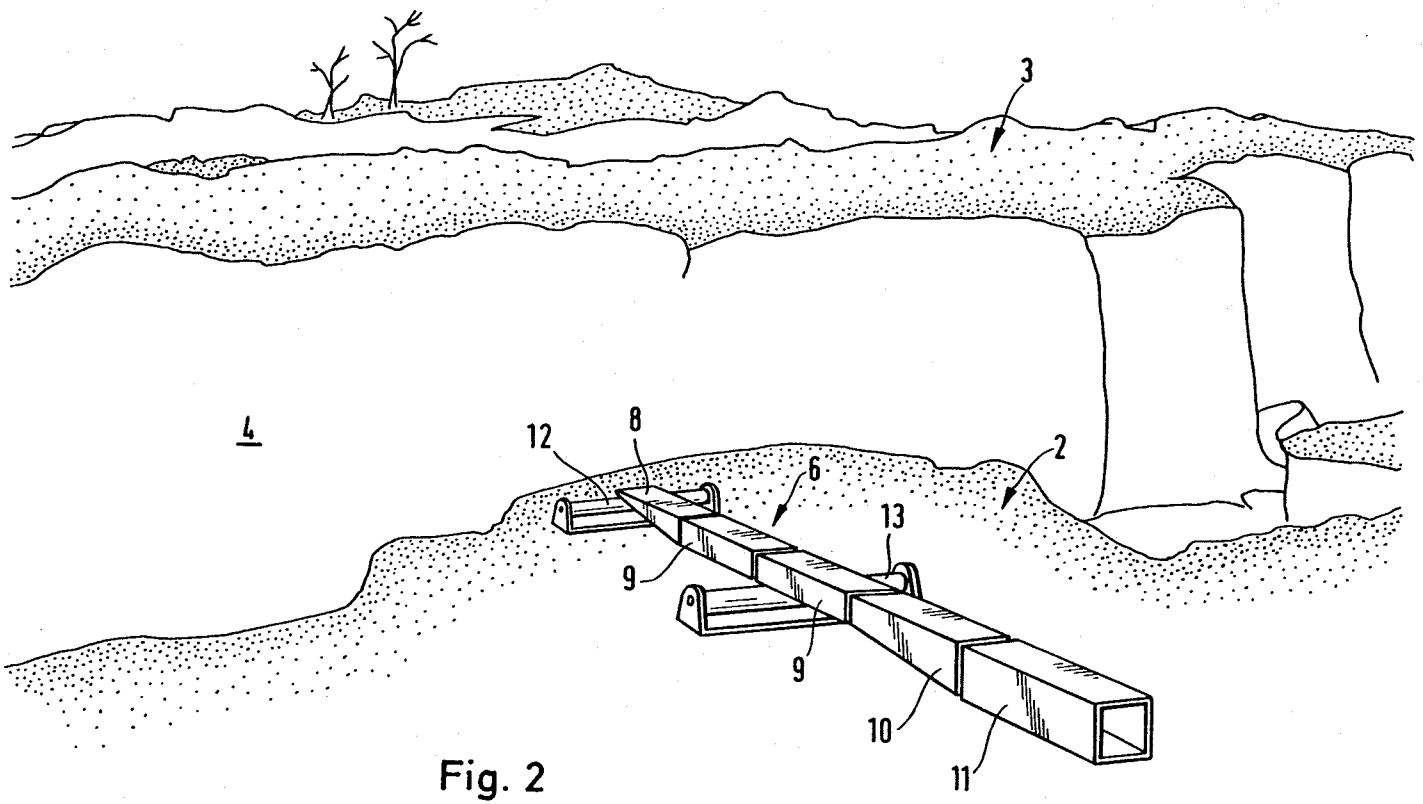
FIGS. 2 to 6 are pictorial views of various stages in the assembly and launching of a bridge according to FIG. 1.

As shown in FIG. 2, the assembly and launching operations carried out on the assembly bank 2 are started by first assemblying the end portion of the central girder whose end section comes to rest on the opposite bank 3 when the bridge is fully assembled and launched. FIG. 2 thus shows an end portion comprising an end section 8, two low sections 9 and a transition section 10, and connected thereto a high section 11. As shown, the central girder 6 that is being assembled rests on two supports 12 and 13 to facilitate its advancement toward the opposite bank 3.

Figure 3:
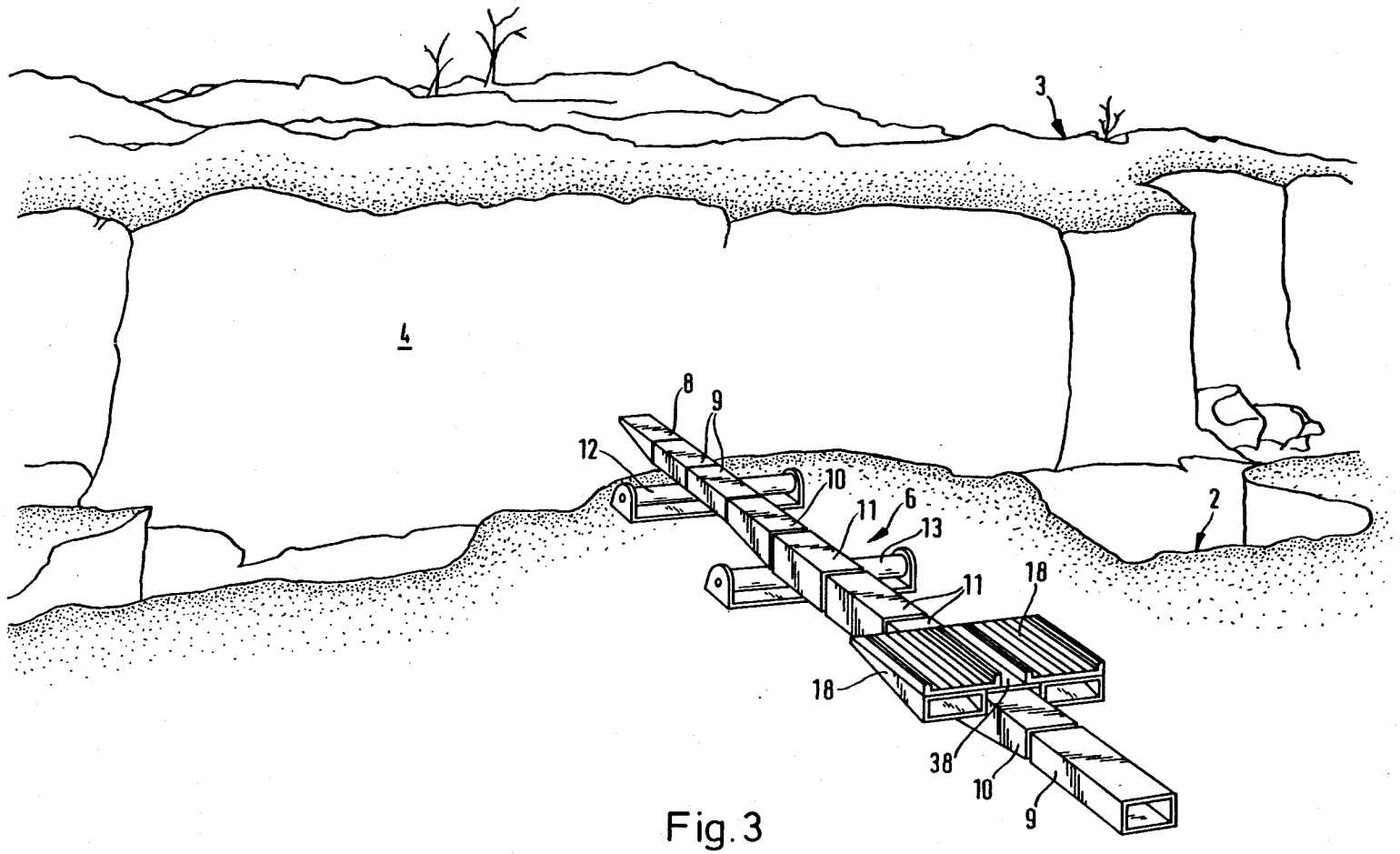

In the assembly and launching stage shown in FIG. 3, the central girder 6 has been elongated and now comprises in addition to the end section 8 the two low sections 9 and the transition section 10, altogether three high sections 11, another transition section 10 and another low section 9. It is also seen that in the assembly and launching stage shown in FIG. 3, the central girder 6 has been further advanced and its front end portion overhangs the canyon 4 in a cantilever beam like fashion.

It is further seen in FIG. 3 that front end sections 18 of the two side girders 5 are now slidably mounted on the two sides of the central girder 6.

Figure 4:
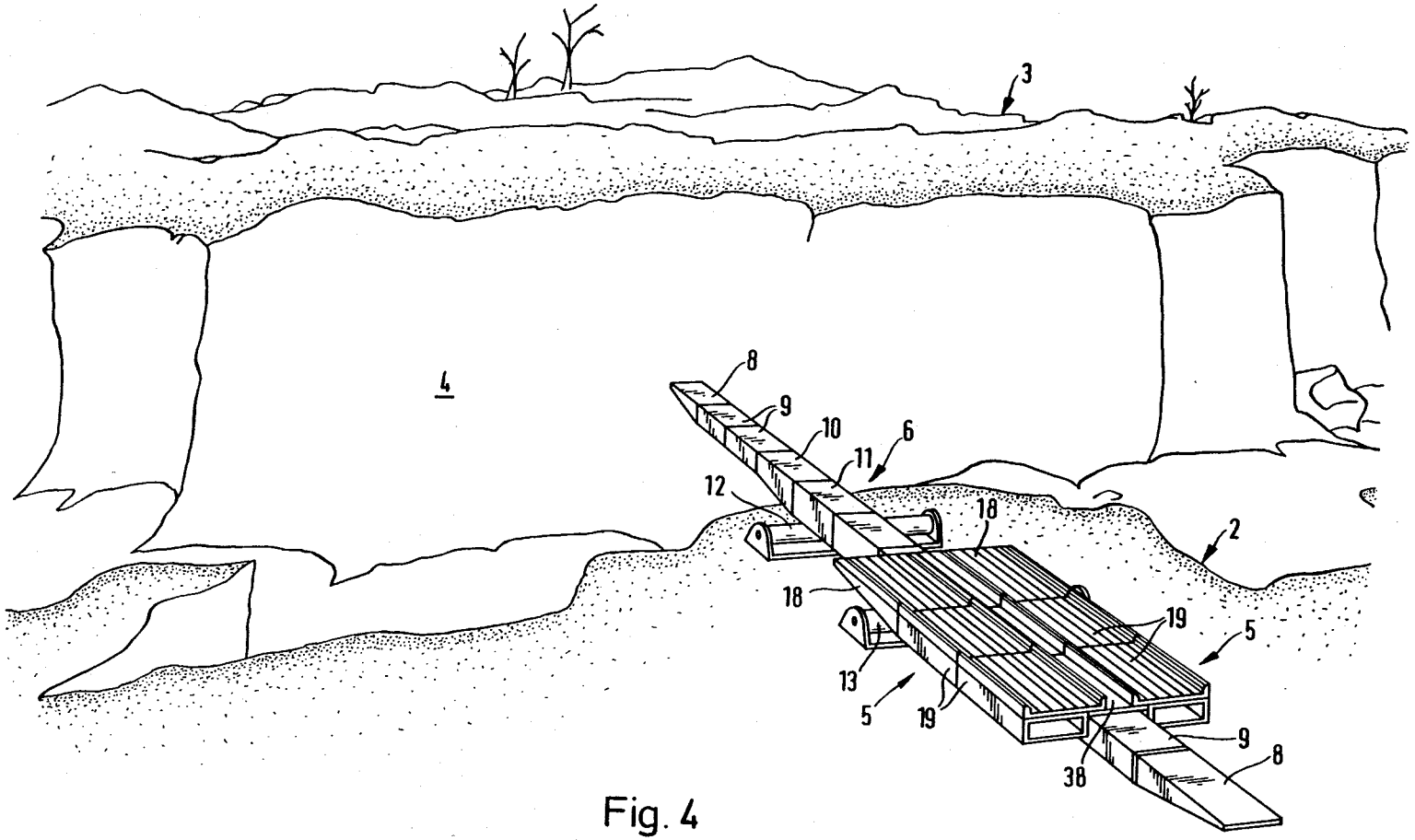

In the assembly and launching stage shown in FIG. 4, the assembly of the central girder 6 is completed. It is also seen that the assembly of the side girders 5 has progressed and now each of them comprises in addition to the end section 18 shown in FIG. 3 also two low sections 19. It is further seen that the central girder 6 has been pushed forward so that the larger portion thereof overhangs the canyon 4 in a cantilever beam like manner.

Figure 5:
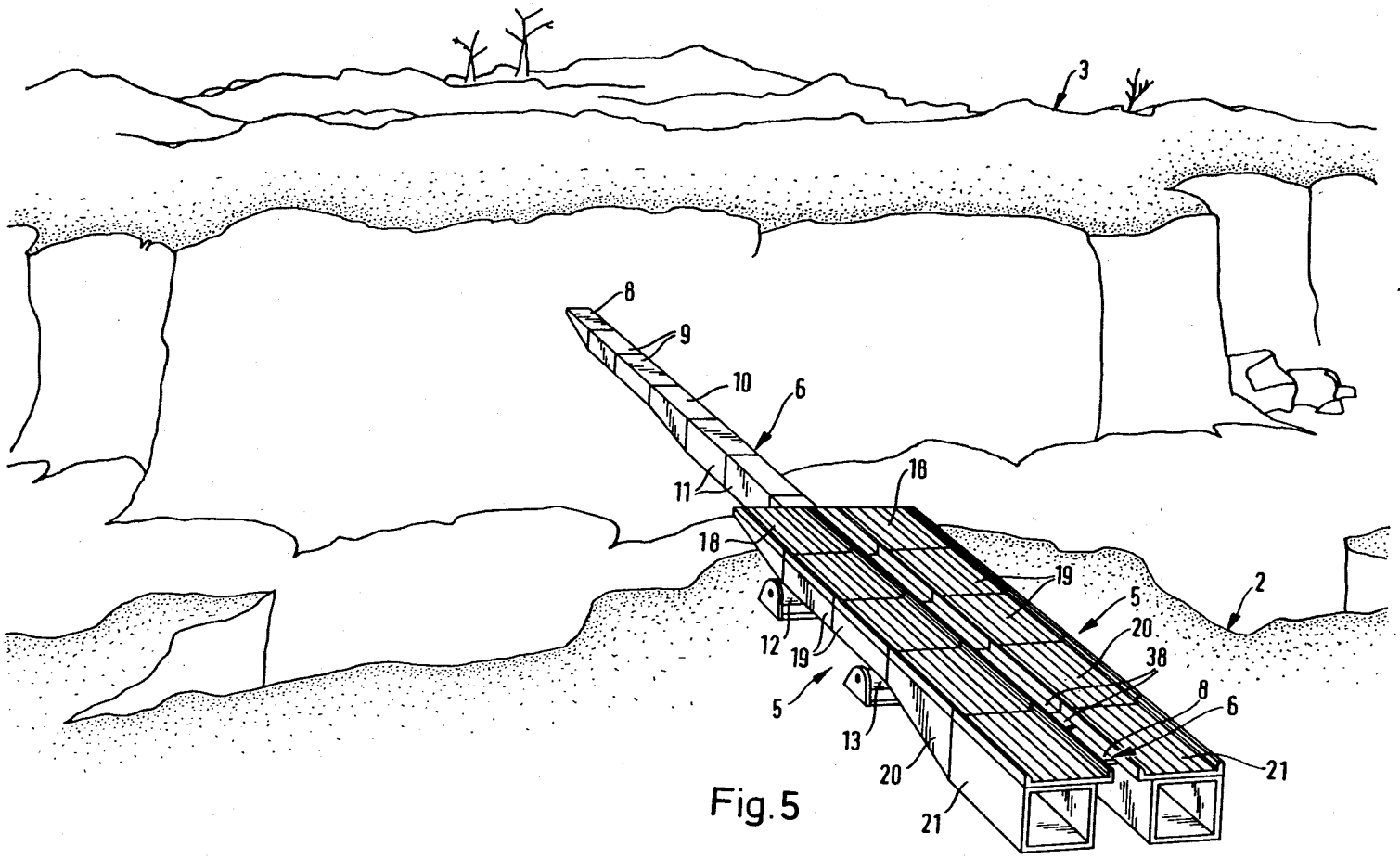

In the assembly and launching stage of FIG. 5, the central girder 6 has been further pushed forward toward the opposite bank 3 and the assembly of the two side girders 5 has progressed, each of them now comprising in addition to the end section 18 and the two low sections 19 also a transition section 20 and a high section 21. Girders 5 are shown here in their initial launching stages with the front end sections 18 having reached the rim of the assembly bank 2.

Figure 6:
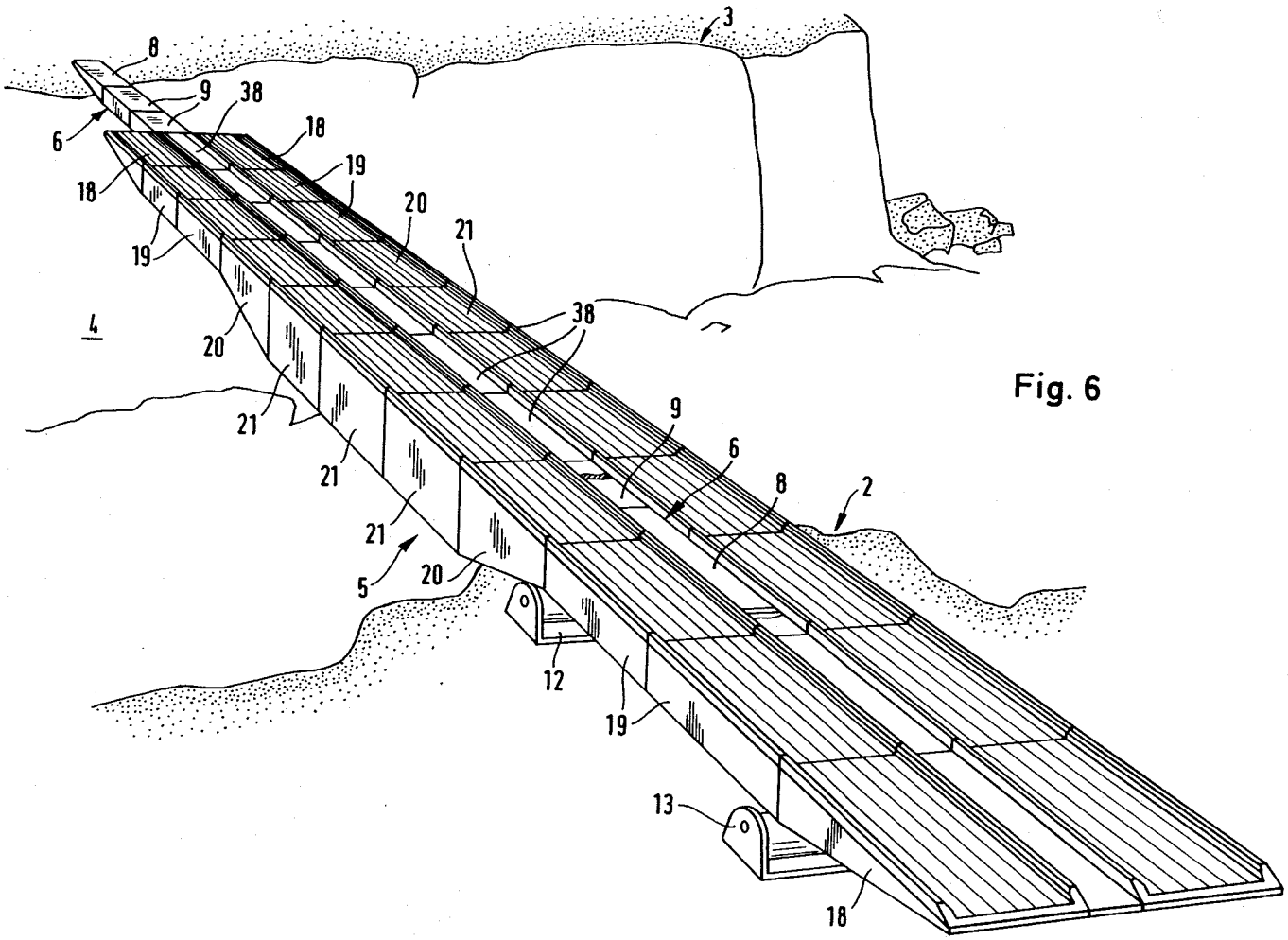

In the assembly and launching stage of FIG. 6, the central girder 6 has reached the opposite bank 3 with the front end section 8 resting on the rim of that bank, and, the assembly of the side girder 5 has been completed with the second end section 18 having been connected. Furthermore, the side girders 5 have also been further advanced alongside the central girder 6. By still further advancing the side girders 5 towards the opposite bank 3, the front end sections 18 eventually come to rest on the rim thereof abreast with the end section 8 of the central girder 6, whereupon the assembly and launching operation is completed and the bridge assumes its final form shown in FIG. 1 in which all end sections on both banks are abreast.

If desired, the side girders 5 may be secured to the central girder e.g. by means of transversal screws or bolts.

It is seen from the foregoing description that the assembly and launching of the two side girders 5 lag behind the assembly and launching of the central girder 6 and because of this lag, the weight of the side girders 5 that are being assembled bears on the central girder 6 whereby the latter retains its cantilever beam like character until its front end section 8 comes to rest on the rim of the opposite bank 3, as shown in FIG. 6. This operational lag by which the central girder 6 retains its cantilever beam like character during the assembly and launching operation is an essential feature of the invention.

Figure 7:
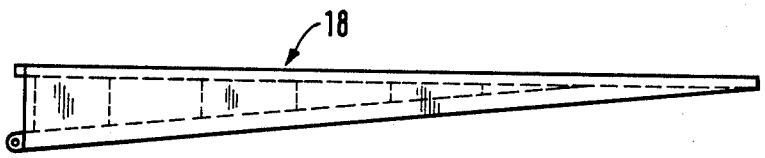
FIGS. 7, 8, 9 and 10 are side elevations of, respectively, an end section, a low section, a transition section and a high section of a side girder of a bridge according to FIG. 1, all drawn to a larger scale.
Figure 8:
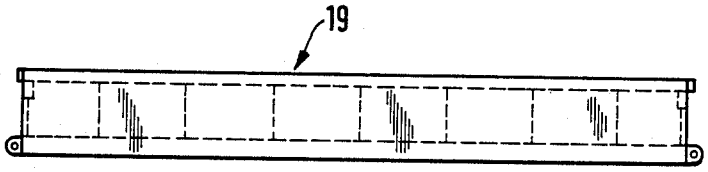
Figure 9:
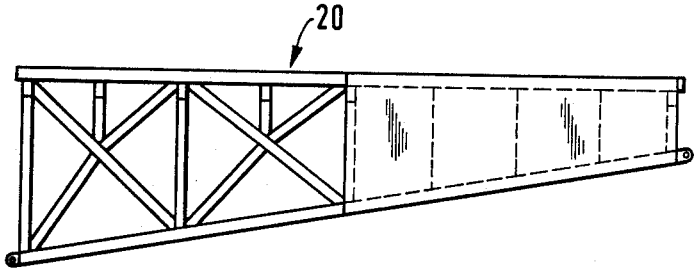
Figure 10:
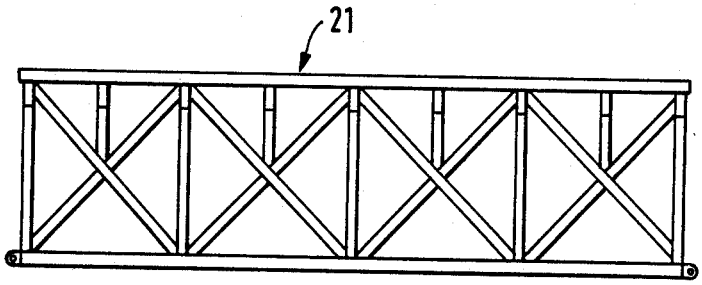
Figure 13:
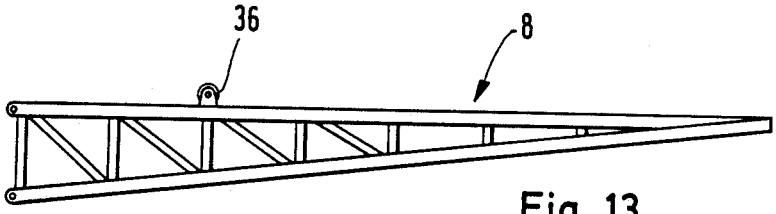
FIGS. 13, 14, 15 and 16 are side elevations of, respectively, an end section, a low section, a transition section and a high section of a central girder of a bridge according to FIG. 1, all drawn to a larger scale.
Figure 14:
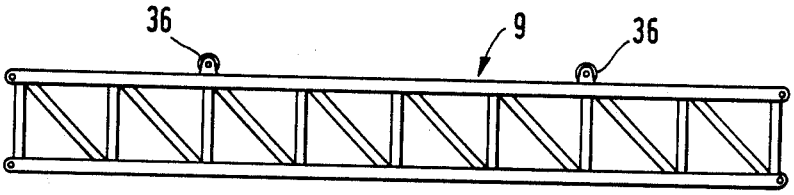
Figure 15:
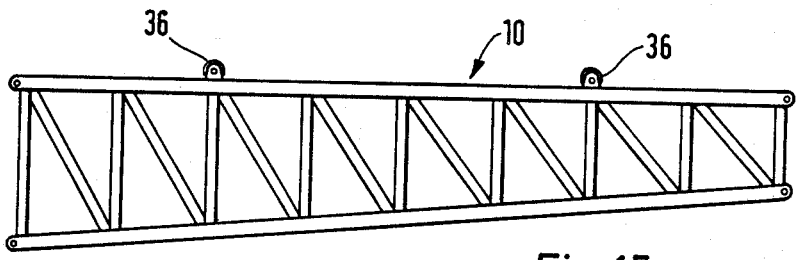
Figure 16:
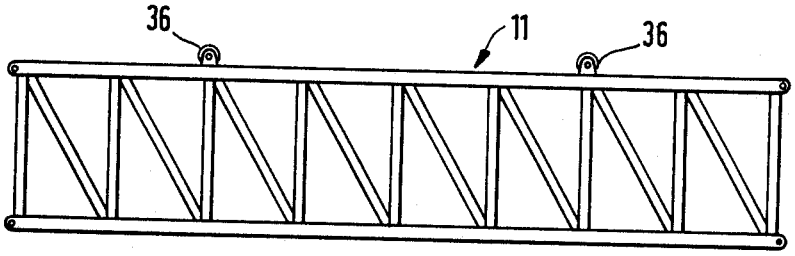

Each of the constituent sections making up the central and side girders of a bridge according to the invention are reinforced by lattices or plates. Thus, the end and low sections 18 and 19 shown respectively in FIGS. 7 and 8 comprise reinforcing plates while the transition section 20 shown in FIG. 9 comprise reinforcing plates on the right hand side of FIG. 9 and reinforcing lattices on the left hand side of FIG. 9. Finally, the high section 21 of a side girder 5 of a bridge according to the invention shown in FIG. 10 is shown there to be entirely reinforced by lattices.

It should be noted that in FIGS. 1–6 all sections of the central girder 6 and side girders 5 are shown to be reinforced by plates, but this need not be so and lattice reinforcements may be used instead.

The design of a high section 21 of a side girder 5 in a bridge according to FIGS. 1–6 is shown in FIGS. 11 and 12. As shown, the high section is shown to have two vertical lattices with braces such as 23, 24, and 25 and a horizontal bottom lattice with braces such as 26 and 27. The high section 21 further comprises an upper panel resting on transversal beams which panel and beams will be referred to herein collectively as "panel 28". In the assembled bridge, panel 28 forms part of a trackway.

As shown in FIG. 12, panel 28 comprises on one side an overhanging bracket 29 and it comprises further two longitudinal rims 30 and 31. The high section 21 further comprises male and female connecting members serving for the interengagement of aligned constituent sections, such as the upper male and female members 32 and 33 and the lower female and male members 34 and 35. All these connecting members 32–35 are provided with transversal holes such that when in the assembled stage two sections are aligned the holes of interengaging connecting members are in register and thereby adapted to receive locking members such as a bolt or screw.

The remaining constituent sections of the side girders 5, to wit end sections 8, low sections 9 and transition sections 10 are mutatis mutandis of similar design and all comprise a trackway forming upper panel similar to panel 28, and male and female connecting members similar to members 32–35.

The end, low, transition and high sections 8, 9, 10 and 11 of a central girder 6 in a bridge according to the invention, are shown, respectively, in FIGS. 13, 14, 15 and 16 and they are essentially of a similar design as the corresponding sections 18, 19, 20 and 21 of the side girders 5 shown in FIGS. 7, 8, 9 and 10 respectively. In the embodiments shown in FIGS. 13–16, all central girder sections are shown to be of the lattice reinforced type, the lattices in this case being of a simple triangular design. It is further seen in FIGS. 13–16 that all constituent sections of the central girder comprise upward projecting connecting members 36 which serve for connection to the overhanging bracket of an associated section of a side girder.

Figure 17:
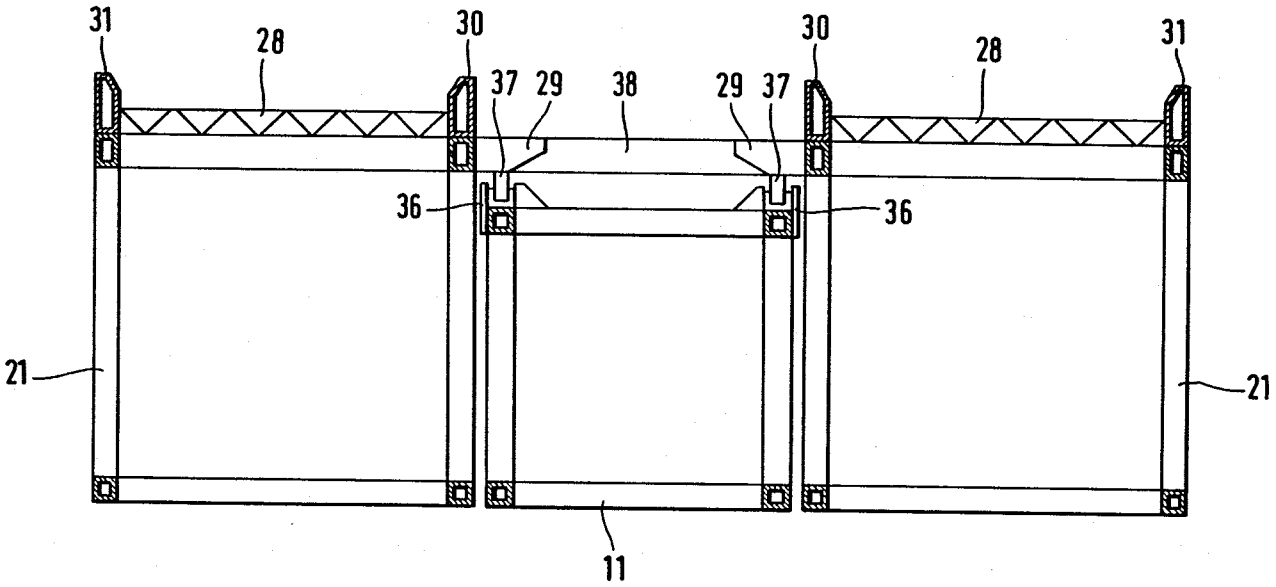
FIG. 17 a section along line XVII—XVII of FIG. 1, drawn to a larger scale.

The manner in which sections of the side girders 5 engage an associated section of the central girder 6 is shown in FIG. 17.

As shown in FIG. 17, a section 11 of the central girder 6 is flanked by two high sections 21 of the side girders 5 with the two overhanging brackets 29 facing each other and overhanging each a portion of the high section 11 of the central girder 6.

Projecting downward from the lower part of brackets 29 of each high section 21 are male connecting members 37 (not shown in FIGS. 11 and 12) which are received by the female connecting members 36 of the center section 11 in the manner shown and are held together by means of transversal screws or bolts (not shown) extending across registering holes of the connecting members 36, 37. The screws or bolts by which the connecting members 36 and 37 are tightened together are placed in position only after the central girder 6 and the side girder 5 have all reached their final position shown in FIG. 1. During all the intermediary positions shown in FIGS. 2–6, the side girders 5 have to be slid along the central girder 6 and this obviously excludes any fixed connection between them before they have all reached their final position.

The gap between the facing rims 30 of the two high sections 21 is closed by a panel 38 connected to brackets 29 in any suitable manner (not shown).

It is readily understood that the engagement between other associated sections of girders 5 and 6, such as end sections 8 and 18, low sections 9 and 19 and transition sections 10 and 20, occurs in an analogous manner.

It is further readily understood from the foregoing description that the length of the bridge can be modified by using different numbers of high sections. For short spans, the high sections may be omitted altogether and, if desired, the transition sections may also be left out. The shortest possible span is achieved by using for each girder only two end sections.

We claim:

1. A rapid deployment stationary bridge comprising a central girder flanked by and independently supporting two separate side girders from one another forming part of the bridge structure, each of said central and side girders comprising a plurality of aligned and connected sections and each having end sections adapted for resting on a bank of an obstacle to be bridged, each of the sections of said side girders having an upper panel whereby a trackway is formed on each of said side girders.

2. A bridge according to claim 1 wherein the central girder independently engages each of the side girders from one another so as to be slidable relative to each other.

3. A bridge according to claim 1 wherein the side girders are secured to the central girder.

4. A bridge according to claim 1 made of steel.

5. A bridge according to claim 1 made of aluminum.

6. A bridge according to claim 1 made of an aluminum alloy.

7. A bridge according to claim 1 made of at rough synthetic material.

8. A bridge according to claim 1 wherein the sections of each of said central girder and two side girdersf are reinforced by panels.

9. A bridge according to claim I wherein the sections of each of said central girder and two side girders are reinforced by lattices.

10. A set of constituent sections for the assembly of a stationary bridge according to claim 1, comprising two end sections, two transition sections and a plurality of low and high sections for the central girder and four end sections, four transition section and a plurality of low and high sections for the side girders, which side girder sections all have an upper, trackway forming panel.

11. A method of deployment of a stationary bridge across an obstacle, which bridge is of a kind that comprises a central girder forming part of the bridge structure and flanked by and joined to two side girders, each of the central and side girders comprising a plurality of aligned and connected sections and each having end sections adapted for resting on a bank of the obstacle to be bridged, each of these sections of the side girders having an upper panel whereby a trackway is formed on each of the side girders, comprising:

(i) assembling the central girder on one bank of the obstacle (assembly bank) by aligning and interconnecting the constituent sections thereof and as the assembly progresses, launching the central girder by gradually advancing it towards the opposite bank of the obstacle;

(ii) as the central girder is advanced, assembling the two side girders on the same assembly bank by slidably mounting the constituent sections of each side girder in alignment on one side of the central girder and interconnecting said sections;

(iii) as said central girder is advanced, launching said side girders by gradually sliding them towards the opposite bank along the central girder so that the advancement of the side girders lags behind the advancement of the central girder, whereby weight of the side girders that are being assembled bears on the central girder, so that the central girder retains a cantilever beam-like character, until a front end section thereof comes to rest on a rim of the opposite bank; and (iv) continuing said assembly and launching operations until the end sections of the central and side girders rest abreast on the opposite bank of the obstacle.

12. The bridge of claim 1, wherein each said side girder section comprises an overhanging bracket positioned over said central girder when the bridge is assembled and provided with downwardly extending ones of male and female connecting members, with each said central girder section comprising upwardly projecting others of said male and female connecting members which mate with one another when the bridge is assembled.

13. The bridge of claim 12, additionally comprising a panel interconnecting said brackets and overlying said central girder sections when the bridge is assembled.

14. The bridge of claim 12, wherein each said side girder section comprises said male members and each said central girder section comprises said female members.

15. The bridge of claim 1, wherein each said section of said side girders comprises a respective pair of male and female members positioned thereon for engagement with respective female and male members of an adjacent side girder section when said respective girders are assembled.

16. The bridge of claim 15, wherein each said side girder section comprises two pairs of male and female members.

17. The bridge of claim 10, wherein a plurality of said transition sections is partially reinforced by lattices and partially reinforced by panels.

* * * * *